US005724245A

United States Patent [19]

Maher et al.

[11] Patent Number: 5,724,245

[45] Date of Patent: Mar. 3, 1998

[54] APPARATUS FOR CONTROLLING A POSTAGE METER AND SELECTING AN INSCRIPTION

[75] Inventors: James P. Maher, Milford; Stanley Rydzak, Brookfield, both of Conn.

[73] Assignee: Pitney Bowes Inc., Stamford, Conn.

[21] Appl. No.: 534,919

[22] Filed: Sep. 28, 1995

[51] Int. Cl.[6] ..... G07B 17/00

[52] U.S. Cl. ..... 364/464.18; 101/71

[58] Field of Search ..... 101/71; 177/25.13, 177/25.15; 364/464.02, 464.03, 464.18

[56] References Cited

U.S. PATENT DOCUMENTS

| | | | |
|---|---|---|---|
| 4,495,581 | 1/1985 | Piccione | 364/464.03 |
| 4,499,545 | 2/1985 | Daniels et al. | 364/464.02 |
| 4,638,439 | 1/1987 | Daniels | 177/25.15 |
| 4,814,995 | 3/1989 | Daniels, Jr. | 364/464.02 |
| 4,831,554 | 5/1989 | Storace et al. | 364/464.02 |
| 4,900,904 | 2/1990 | Wright et al. | 364/464.03 X |
| 4,907,162 | 3/1990 | Fougere | 364/464.02 |
| 4,910,686 | 3/1990 | Chang et al. | 364/464.02 |
| 5,392,216 | 2/1995 | Bystrianyk et al. | 364/464.02 |
| 5,471,925 | 12/1995 | Heinrich et al. | 364/464.02 X |
| 5,490,077 | 2/1996 | Freytag | 364/464.02 |
| 5,602,743 | 2/1997 | Freytag | 364/464.18 |

*Primary Examiner*—Edward R. Cosimano

*Attorney, Agent, or Firm*—Melvin J. Scolnick; Robert H. Whisker; Robert E. Meyer

[57] ABSTRACT

A postal scale having a programmable capability to automatically select inscriptions to be included in a postage meter indicia. The postal scale includes a CPU and memory, a load cell for determining the weight of a mail piece, a keyboard for input of postal information and a display for output of information to an operator; and determines postage value data for a mail piece in a conventional manner. In an inscription selection mode the postal scale outputs inscription selection data to a postage meter to select an appropriate inscription to be included in the meter indicia. The scale determines the inscription selection data as a prioritized function of postal information input by an operator to determine postage value data. In a programming mode an operator may program the function as a table stored in the scale memory.

18 Claims, 5 Drawing Sheets

FIG. 1
(PRIOR ART)
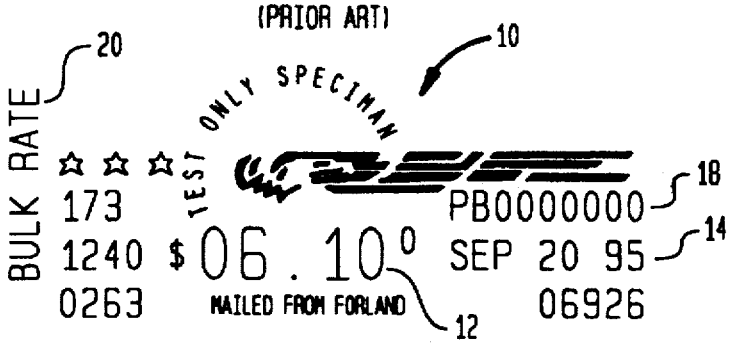
FIG. 3
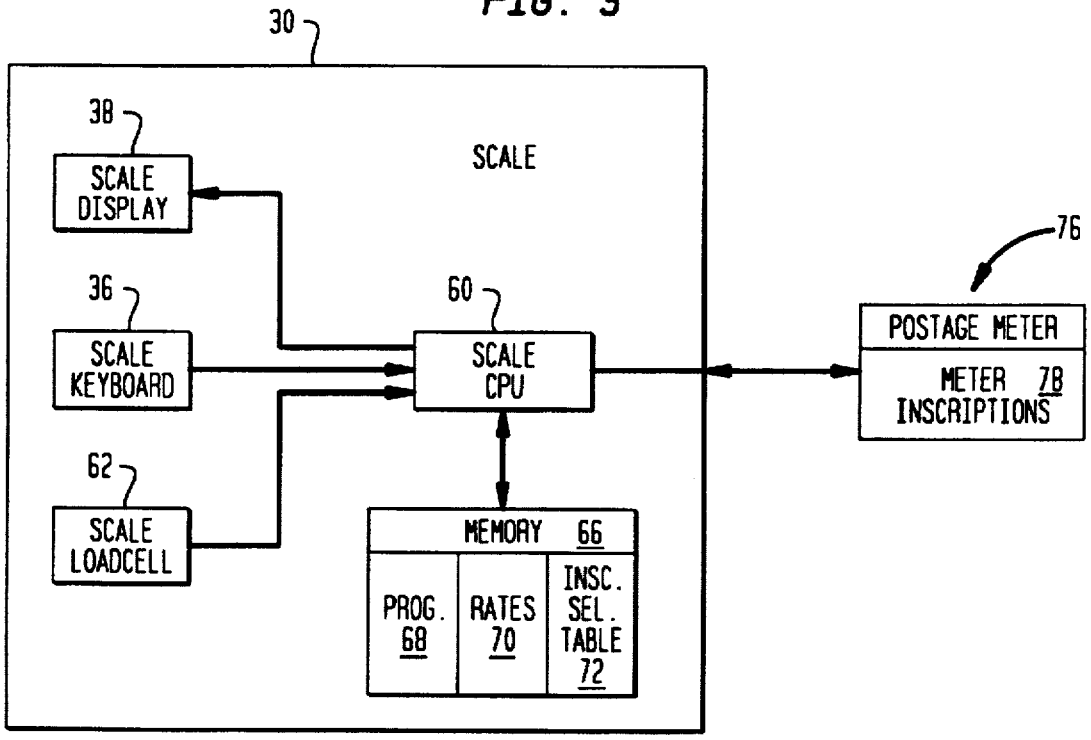
FIG. 4
| ENTRY # (PRIORITY) | CLASS OF SERVICE | TYPE CODE | ZONE | SPECIAL FEES | INSCRIPTION CODE |
|---|---|---|---|---|---|
| 1 (HIGHEST) | - | - | - | S.D. | w |
| 2 | 1st | - | - | - | x |
| ≈ | ≈ | ≈ | ≈ | ≈ | ≈ |
| n-1 | 1st | | N | S.D. | y |
| n (LOWEST) | - | - | N | S.D. | z |
72

APPARATUS FOR CONTROLLING A POSTAGE METER AND SELECTING AN INSCRIPTION

BACKGROUND OF THE INVENTION

The subject invention relates to apparatus for controlling a postage meter or the like. More particularly, it relates to a postal scale having a capability to determine appropriate postal charges for a mail piece and to automatically select an inscription to be included in a postal indicia.

Postage meters are known to provide a convenient means for franking of mail pieces. Such meters typically print indicia representative of an appropriate postage amount on a mail piece while accounting for the postage expended in a manner which is well known to those skilled in the art. FIG. 1 shows typical indicia 10, which includes postage amount representation 12, date 14, and serial number 18 as well as other elements which are included to hinder counterfeiting or fraud. Indicia 10 also includes inscription 20 which is provided to indicate the type of handling required by the mail piece. In FIG. 1 inscription 20 indicates that the mail piece is bulk rate mail. Other inscriptions might indicate that the mail piece was first class, priority mail, or indicate that fees for special services such as registered mail or special delivery mail had been paid.

U.S. Pat. No. 5,392,216; issued Feb. 21, 1995 to Bystrianyk et al. discloses a mailing system including a postage meter having a capability to automatically select an inscription which will indicate the mail class of a mail piece. That is, a mail piece franked at the First Class rate will be marked with an inscription "First Class", etc.

While useful for its intended purpose such a system is limited to only a small set of possible inscriptions based upon a single element of the postal information which can be used to determine postal charges for a mail piece. As noted, other inscriptions such as "Special Delivery" are also recognized by the Postal Service and recently introduced meters, such as the models B700 and B900 marketed by Pitney Bowes Inc. of Stamford Conn., include a capability for remotely selecting one of several inscriptions to be included in an indicia. However, even the newest of such meters has capacity for only a small fraction of the large number of inscriptions which are used with various postal services around the world. Thus when a user orders such a postage meter the user is given the opportunity to select a subset of the available inscriptions which will be most useful. As a result hundreds, if not thousands, of possible combinations of inscriptions are incorporated in postage meters in the field, and of course such inscriptions may be changed from time to time as a user's requirements change.

A second problem not dealt with in the prior art is the need for prioritization in the selection of inscriptions, thus, a user may normally wish to inscribe first class mail as "First Class" but, in the event the mail is registered, may wish to mark first class mail as "Registered".

Thus it is a object of the subject invention to provide an apparatus with capability for flexibly and conveniently controlling the selection of inscriptions to be printed by a postage meter, where the postage meter may include any of a large number of possible combinations of available inscriptions.

BRIEF SUMMARY OF THE INVENTION

The above object is achieved and the disadvantages of the prior art are overcome in accordance with the subject invention. By means of an apparatus for controlling a postage meter, where the postage meter includes an input for input of postage value data and inscription selection data.

The apparatus includes an input for input of a plurality of postal information parameters for a mail piece and for input of programming data. The apparatus also includes a control element responsive to the input and having first and second modes of operation; wherein the first mode of the apparatus determines postal value data in accordance with the postal information parameters, and determines the inscription selection data as a function of the postal information parameters. In the second mode the control mechanism determines the function relating the postal information parameters to the inscription selection data in accordance with the input programming data. The apparatus also includes an output, responsive to the control mechanism, for output of the postage value data and the inscription selection data to a postage meter.

In accordance with one aspect of the subject invention the function for selecting the inscription selection data is a prioritized function of the postal information. That is, not all of the postal information parameters are specified for each case, so that a particular value of the postal information may be consistent with more then one case, in which event the case having the higher priority is selected.

In accordance with another aspect of the subject invention, the apparatus is a postal scale and includes a weight transducer for determining a weight for the mail piece, and the control mechanism determines the postage value data as a function of the weight and the postal information.

Thus it can be seen that the subject invention advantageously achieves the above object, and other objects and advantages of the subject invention.

BRIEF DESCRIPTION OF THE DRAWINGS

FIG. 1 shows a prior art postal indicia as printed by a typical postage meter.

FIG. 3 is a block diagram of a mailing system including a postal scale in accordance with the subject invention and a conventional postage meter having a capability for selectively printing one of a plurality of inscriptions.

FIG. 4 is a tabular representation of a prioritized function for selecting inscription selection data.

DETAILED DESCRIPTION OF THE PREFERRED EMBODIMENTS OF THE SUBJECTS INVENTION

Figure 2:
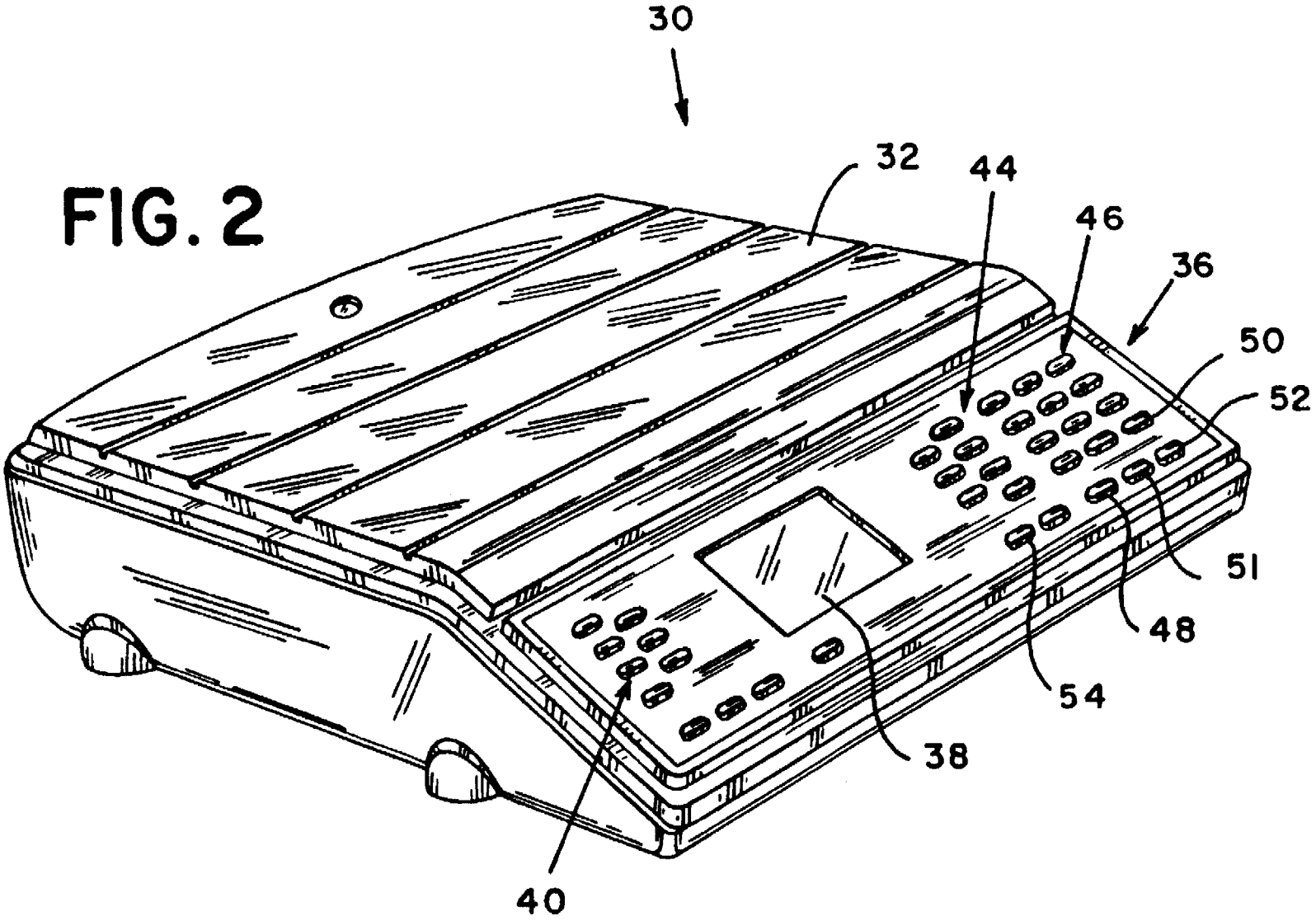
FIG. 2 is a perspective view of a postal scale incorporating a capability for automatic selection of postage meter inscriptions in accordance with the subject invention.

FIG. 2 shows a perspective view of postal scale 30. Scale 30 includes platform 32, for supporting a mail piece to be weighed and mailed, keyboard 36 for entry of various elements, or parameters, of postal information used to determine postage value data for the mail piece and display 38 for display of postage values and various postal information parameters.

As is conventional, when a mail piece is placed on platform 32 scale determines its weight and, as an operator enters various postal information parameters, computes and displays postage value data for the mail piece. An operator can enter a class of service, such as First Class or Express Mail, through keys 40 and can select various special fee services, such as Special Delivery, through keys 44. Postal information parameters can also include a delivery zone which is entered through numeric keypad 46 and Zone Code 48. Enter key 50 and Clear key 51 are used to input postal information in a conventional manner, and, once postage value data is computed for a mail piece, Meter Set key 52 causes scale 30 to transmit the postage value data to a postage meter, in a well known manner.

Postal scale 30 also includes Inscription Select key 54, which enables and disables an Inscription Select function. As will be described further below when the Inscription Select function is enabled scale 30 will, for certain selected postal information cases, determine inscription selection data to be output to a postage meter to select an inscription when Meter Set key 52 is pressed.

In a preferred embodiment of the subject invention an operator may enter a programming mode to program the Inscription Select function by quickly depressing key 54 twice, or in any other convenient manner which may be selected.

FIG. 3 shows a schematic block diagram of scale 30. As noted above keyboard 36 and display 38 are connected to CPU 60 to provide an operator interface. Load cell 62 supports platform 32 and outputs a signal representative of the weight of a mail piece on platform 32 to CPU 60. CPU 60 is also connected to memory 66, which includes program memory 68, which is preferably Read-Only-Memory and postal rates 70, which are preferably stored in replaceable Programmable Read-Only-Memory modules. As is well known in the art, CPU 60 is controlled by code stored in program memory 68 to compute postage value data as a function of weight measured by load cell 62, postal information input through keyboard 36, and rates stored in rate memory 70.

In accordance with the subject invention scale 30 further includes inscription selection table 72 in memory 66 and additional program code in program memory 68 to control CPU 60 to determine inscription selection data as a function of postal information input through keyboard 36 and inscription selection tables 72, as will be described further below.

FIG. 3 also shows postage meter 76 connected to scale 30 for reception of postage value data and inscription selection data. As is well known meter, 76 responds to postage value data to cause indicia 10 to include an indication 12 of the appropriate postage value for the mail piece as determined by scale 30. As discussed above, postage meter 76 also includes a capability to incorporate a selected one of inscriptions 78 into indicia 10 in response to inscription selection data. In some models of postage meter 76 the inscription selection function may be carried out by a mechanical element, while in newer models of postage meter 76, where indicia 10 is printed by a matrix type printer, the inscription selection function may be carried out electronically. These details of the implementation of the inscription selection function in postage meter 76 form, however, no part of the subject invention.

Turning to FIG. 4 a schematic representation of inscription selection table 72 is shown.

In FIG. 4 each entry includes an inscription code which will control postage meter 76 to print a corresponding inscription and selected values for various postal information parameters. Because of the large number of possible cases for the postal information it is believed preferable that entries in the table of FIG. 4 need not be fully specified. Thus, for entry number 1 only the Special Fee parameter is specified as Special Delivery, and the remaining parameters are "don't care". Thus, to output code w the input postal information need only actually match, i.e. include Special Delivery, for the Special Fee parameter.

Because the entries are not fully specified, more than one entry may be consistent with a particular postal information case and the function of FIG. 4 is therefore prioritized with entry number 1 having the highest priority. However, in a preferred embodiment of the subject invention the entry number priority is subordinate to the "best fit". (By "best fit" herein is meant the entry which is consistent with the input postal information case for the mail piece being processed and which has the highest number of actual matches.)

Thus, in the table shown in FIG. 4, a mail piece having the parameters: First Class, Zone n, Special Delivery, would select entry n-1 and output inscription code y since entry n-1 would be the best fit. If entry n-1 where deleted from table 72, then entry n would be the best fit and code z would be output. If both entries n-1 and n were deleted, then entries 1 and 2 would be equally good fits and entry 1 would be selected and code w output, since entry 1 has the higher priority. Details of the manner in which entries are selected from table 72 are described more fully below.

It should be noted that the Type Code parameter shown in FIG. 4 is a parameter descriptive of the size of a mail piece, which is not generally used in U.S. postal rates but is common in the postal rates of other countries, and which is included in the preferred embodiment shown so that scale 30 may easily be adapted for international markets.

Figure 5A:
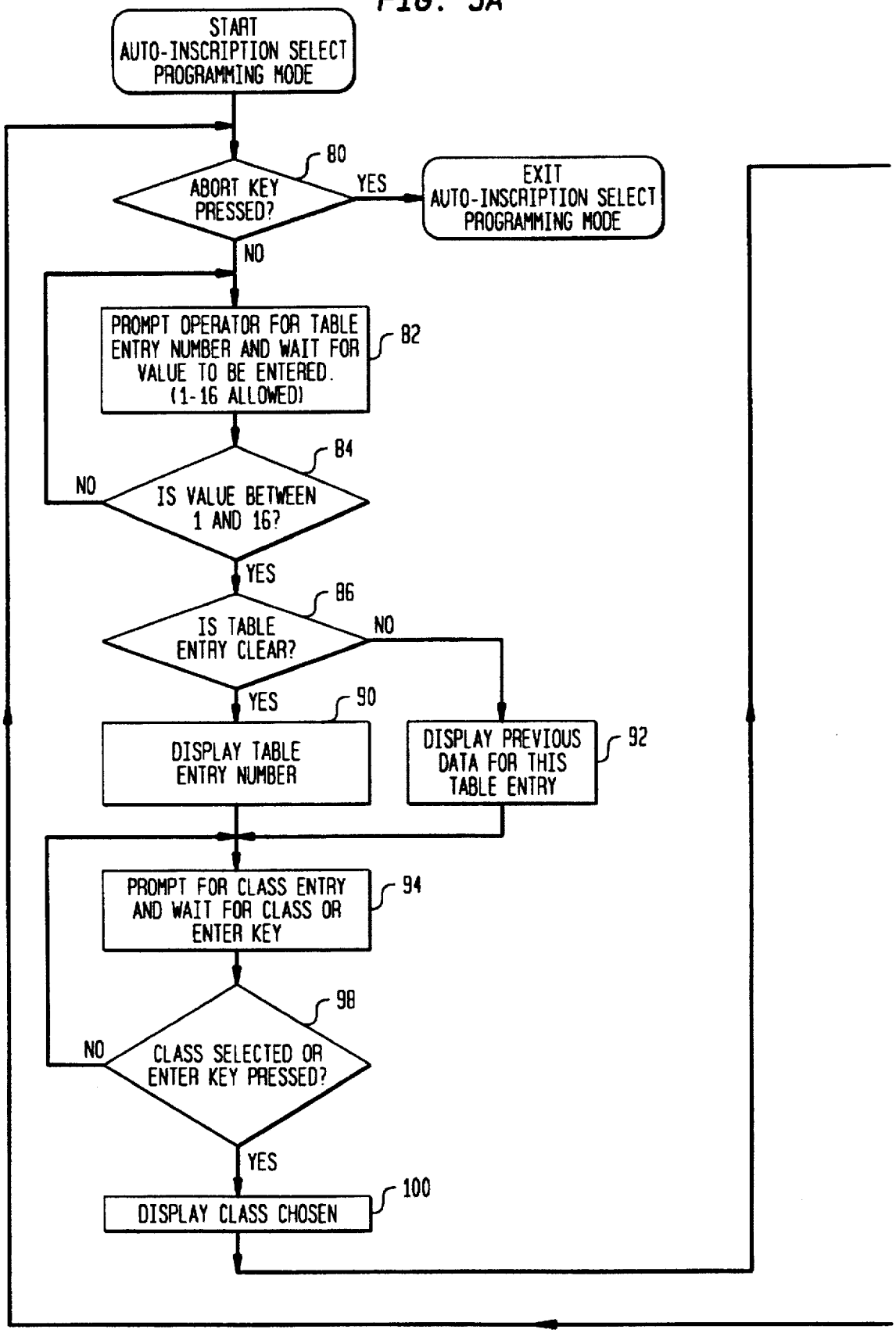
FIG. 5 is a flow diagram of the operation of the apparatus of the subject invention in programming the function of FIG. 4.
Figure 5B:
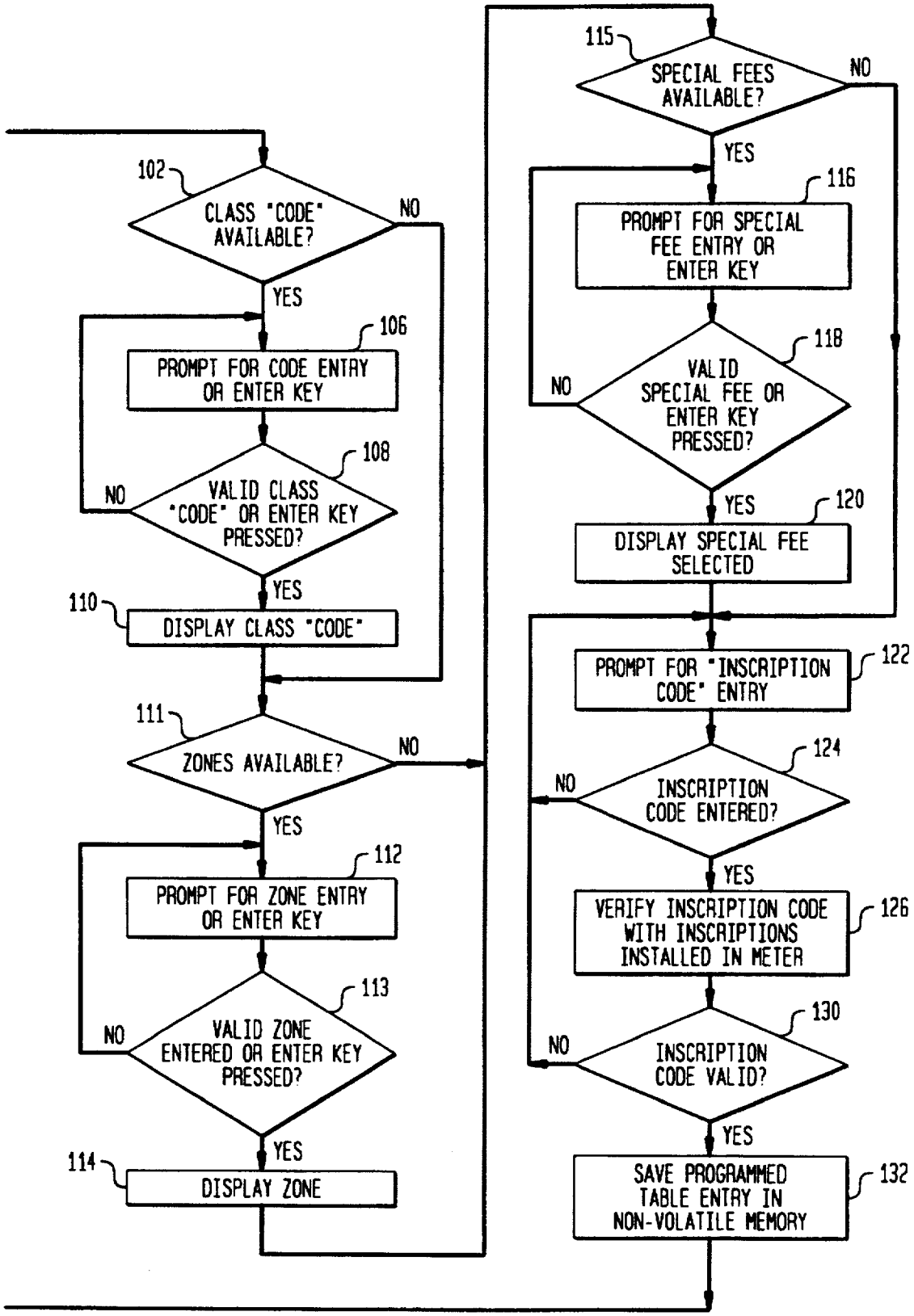

FIG. 5 shows a flow diagram of the operation of scale 30 in a programming mode for programming of inscription selection table 72.

At 80 CPU 60 tests to determine if an operator has pressed an abort key to exit the programming mode, and if so exits. Otherwise, at 82 a prompt is displayed for the operator to enter an entry number and CPU 60 waits for entry of an entry number. At 84 CPU tests to determine if the entry number is valid, i.e. in the embodiment shown, is a number between 1 and 16. If an invalid entry is made CPU 60 returns to 82. Otherwise, CPU 60 advances to a query at step 86. At step 86, CPU 60 queries as to whether or not the table entry made at step 82 has been cleared for use. If the response to the query is "NO," then at step 92 display 38 displays the previous data entered for the particular table entry; if, however, the response to the query at step 86 is "YES," then at step 90 display 38 displays the specified table entry number. In either case, at 94, display 38 displays a prompt for entry of a selected class of service, and at 98 CPU 60 tests to determine if a class has been entered or enter key 50 has been pressed. (In all cases if an operator presses enter key 50 without specifying a postal information parameter a "don't care" is entered for that parameter in the specified entry.)

If CPU 60 determines at step 98 that a class has not been selected, or that enter key 50 has been pressed, then CPU 60 returns to step 94. Once a class is selected or enter key 50 is pressed, then at 100 display 38 displays the selected class and at 102 tests to determine if a type code is available, that is, CPU 60 tests to determine if scale 30 is programmed to consider type codes in determining postage values. If so, then at 106 scale 30 prompts for selection of a type code and, advances to a query at step 108. At step 108 CPU 60 determines whether or not a valid class code has been entered or the enter key pressed. If the response to the query at step 108 is "YES," then the CPU advances to step 110. If, however, the response to the query at step 108 is "NO," then the CPU returns to step 106. At step 110, display 38 displays the selected code and goes to 111. If type code is not available in scale 30, CPU 60 goes directly to 111.

Then at 111. CPU 60 tests to determine if a zone parameter is available: that is, CPU 60 tests to determine if scale 30 is programmed to consider zone parameters in determining postage values. If so, then at 112, scale 30 prompts for entry of a zone parameter and advances to a query at 113. At step 113, CPU 60 determines if a valid zone parameter has been entered. If the response to the query is "YES", then CPU 60 advances to step 114 and displays the selected zone and continues to step 115. If, however, the response is "NO", then CPU 60 returns to 112.

if, at 111, CPU 60 determines that zone parameters are not available in scale 30, CPU 60 goes directly to 115.

At 115, CPU 60 tests to determine if a special fee parameter is available; that is, CPU 60 tests to determine if scale 30 is programmed to consider special fees in determining postage values. If so, then at 116, scale 30 prompts for selection of a special fee and advances to a query at 118. At 118, CPU 60 determines if a valid special fee has been entered. If the answer is "YES", then CPU 60 advances to step 120 and displays the selected special fee, and continues to step 122. If, however, the response is "NO", then CPU 60 returns to 116. If, at 115, CPU 60 determines that special fees are not available in scale 30, CPU 60 goes directly to 122.

Once all postal information parameters have been specified, either with particular values or as "don't care" then, at 122, display 36 displays a prompt for an inscription code entry. As discussed above this code will be output to meter 76 as inscription selection data to control meter 76 to select a specified inscription when scale 30 is in the inscription selection mode and the meter set button is pressed, as will be described further below. At 124, CPU 60 tests to determine if an inscription code has been entered, and if not loops back to 122. At 126, once an inscription code is entered, CPU 60 communicates with meter 76 to determine if the corresponding inscription is installed in meter 76, and at 130, tests to determine if the corresponding inscription is installed in meter 76. If not, CPU 60 again loops back to 122 and otherwise, at 132, saves the programmed entry in memory 66 and returns to 80.

Preferably, values displayed at 90, 100, 110, 114 and 120 can be cleared by pressing clear key 51 and an abort may be entered by quickly pressing key 51 twice, or in any other convenient manner which may be chosen.

Figure 6:
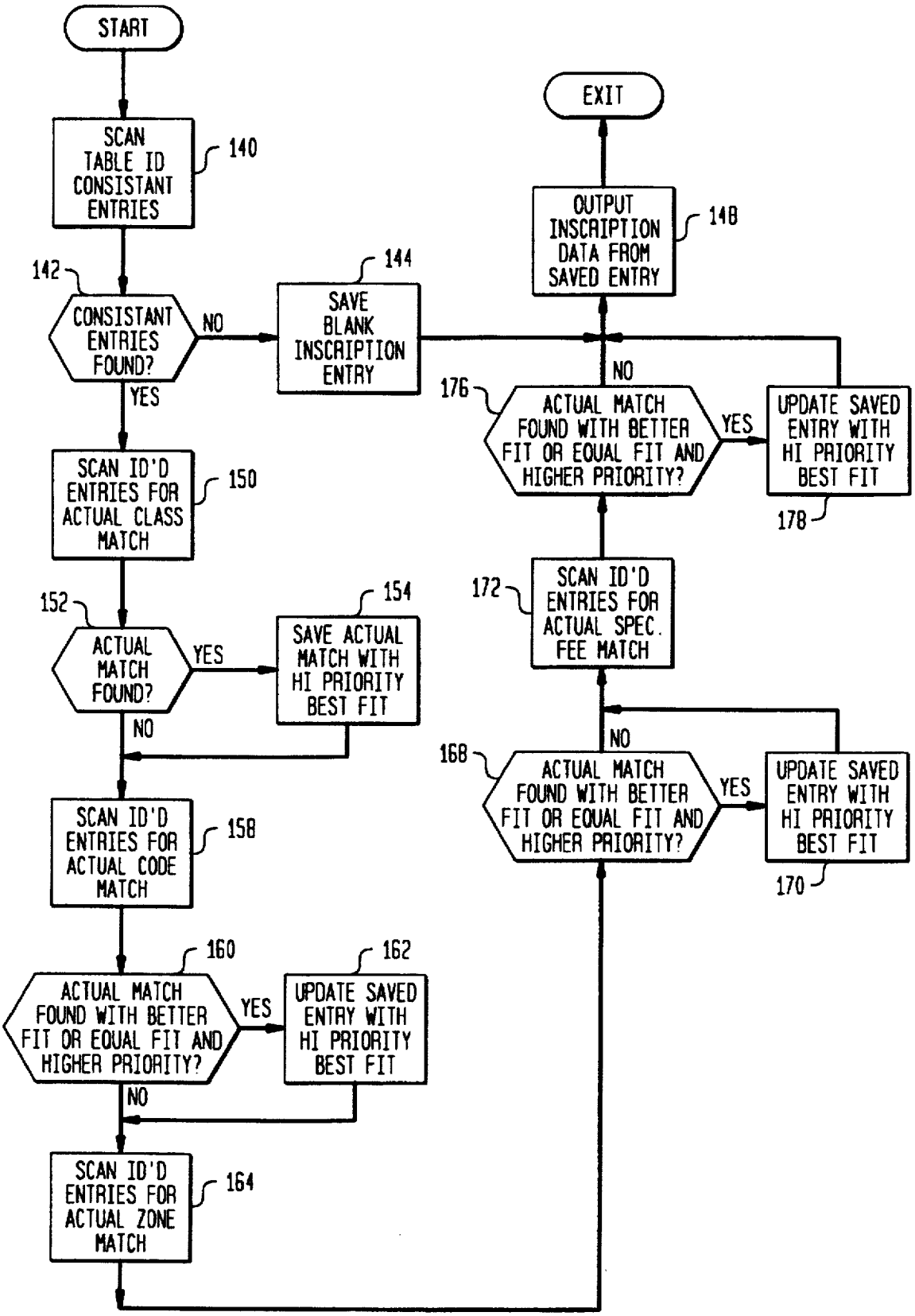
FIG. 6 is a flow diagram of the operation of the apparatus of the subject invention in selecting inscription selection data.

FIG. 6 shows a flow diagram of the operation of scale 30 in an inscription selection mode. An operator places a mail piece on platform 32 and enters appropriate postal information through keyboard 36 to determine postage value data to be output to meter 76 to set meter 76 to properly frank the mail piece with appropriate postage values in a conventional manner well known to those skilled in the art. When scale 30 is in the inscription selection mode, then at 140 CPU 60 scans table 72 to identify entries in table 72 which are consistent with the actual postal information case entered for the mail piece being processed. An entry is consistent with a particular postal information case when, for each parameter, the entry is either a "don't care" or actually matches the corresponding postal information parameter specified in that case.

At 142, CPU 60 tests to determine if consistent entries have been found and if not, at 144 saves a blank inscription entry (which is not part of table 72) and, at 148 outputs inscription data from the saved entry and exits.

If consistent entries are found then at 150 CPU 60 scans the identified entries for an actual match between the class specified for the mail piece and the programmed class value for each identified entry. That is, CPU 60 further identifies those consistent entries where a class value has been specified, i.e. is not a "don't care". At 152, CPU 60 tests to determine if one or more actual class matches have been found and if so, at 156, saves the actual match with the best fit. If two actual matches have an equal fit the entry having the higher priority is saved.

Then, in either case at 158, CPU 60 scans the identified consistent entries for an actual type code match. At 160 CPU 60 determines if one or more actual matches have been found which have a better fit, or an equal fit and higher priority, than the saved entry. If so, at 162, the saved entry is updated with the best fit entry having the highest priority. Otherwise CPU 60 goes directly to step 164.

Then, at 164, CPU 60 scans the identified consistent entries for an actual match on the zone parameter. At 168, CPU 60 determines if one or more actual matches have been found which have a better fit, or an equal fit and higher priority, than the saved entry. If so, at 162, the saved entry is updated with the best fit entry having the highest priority. Otherwise, CPU 60 goes directly to step 172.

Then, at step 172, CPU 60 scans the identified consistent entries for an actual match on the special fee parameter. At 176, CPU 60 determines if one or more actual matches have been found which have a better fit, or an equal fit and higher priority, than the saved entry. If so, at 178, the saved entry is updated with the best fit entry having the highest priority.

CPU 60 then goes to 148 to output inscription data from the saved entry and exits. If no actual match is found at 164, then CPU 60 goes directly to 148.

Those skilled in the art will recognize that the operation shown in FIG. 6 will prioritize entries in accordance with the fit between an entry and the postal information case for a mail piece. Priority between entries having an equally good fit is determined on the basis of entry number, with entry number 1 having the highest priority.

In accordance with another embodiment of the subject invention, by modifying the tests at 160, 168, and 176 so that the saved entry is only updated if an actual match with a better fit is found, priority is determined first in the order of goodness of fit, then based upon whether an actual match is found for the class, type code, zone, or special fee parameters, in that order, and then on the entry number priority.

The above embodiments of the subject invention have been described by way of example only, and numerous other embodiments of the subject invention will be apparent to those skilled in the art from consideration from the detailed descriptions set forth above and the attached drawings. Accordingly, limitations on the subject invention are to be found only in the claims set forth below.

What Is claimed:

1. An apparatus for controlling a postage meter, said postage meter including an input for input of postage value data and inscription selection data, said apparatus comprising:

a) input means for input of a plurality of postal information parameters for a mail piece;

b) control means, responsive to said input means for:

b1) determining said postage value data in accordance with said postal information; and b2) determining said inscription selection data as a prioritized function of said postal information parameters wherein said inscription selection data is incompletely determined by said postal information, so that more than one inscription selection data value can be consistent with said postal information, and said control means selects among values of said inscription selection data which are consistent with said postal information in accordance with a predetermined prioritization of said inscription selection data values; and c) output means, responsive to said control means for output of said postage value data and inscription data.

2. An apparatus as described in claim 1 further comprising a scale for determining a weight for said mail piece, said control means determining said postage value data a function of said weight and said postal information.

3. An apparatus as described in claim 1 wherein said control means comprises a memory and said prioritized function is stored in said memory as a table; each entry in said table associating an inscription code with specified values for each of said postal information parameters said values being either a either particular values for said parameters or a "don't care" value.

4. An apparatus as described in claim 3 wherein said inscription code for an entry is output as said inscription selection data for a mail piece if said entry is the highest priority entry consistent with the input postal information for said mail piece; and said entries are prioritized in accordance with the number of actual matches between said input postal information and said entries.

5. An apparatus as described in claim 4 wherein said entries are further prioritized in accordance with the order of said entries in said table.

6. An apparatus as described in claim 4 wherein said entries are further prioritized in accordance with whether or not particular ones of said parameters actually match said entries.

7. An apparatus as described in claim 6 wherein said entries are further prioritized in accordance with the order of said entries in said table.

8. An apparatus for controlling a postage meter, said postage meter including an input for input of postage value data and inscription selection data, said apparatus comprising:

a) input means for input of a plurality of postal information parameters for a mail piece and for input of programming; data b) control means, responsive to said input means and having first and second modes of operation, for b1) in said first mode, determining said postage value data in accordance with said postal information parameters; and b2) determining said inscription selection data as a prioritized function of said postal information parameters, wherein said inscription selection data is incompletely determined by said postal information, so that more than one inscription selection data value can be consistent with said postal information, and said control means selects among values of said inscription selection data which are consistent with said postal information in accordance with a predetermined prioritization of said inscription selection data values; and b3) in said second mode, determining said function in accordance with said programming data; and c) output means, responsive to said control means for output of said postage value data and said inscription selection data.

9. An apparatus as described in claim 8 further comprising a scale for determining a weight for said mail piece, said control means determining said postage value data a function of said weight and said postal information.

10. An apparatus as described in claim 8 wherein said control means comprises a memory and said prioritized function is stored in said memory as a table; each entry in said table associating an inscription code with specified values for each of said postal information parameters said values being either particular values for said parameters or a "don't care" value.

11. An apparatus as described in claim 10 wherein said inscription code for an entry is output as said inscription selection data for a mail piece if said entry is the highest priority entry consistent with the input postal information for said mail piece; and said entries are prioritized in accordance with the number of actual matches between said input postal information and said entries.

12. An apparatus as described in claim 11 wherein said entries are further prioritized in accordance with the order of said entries in said table.

13. An apparatus as described in claim 11 wherein said entries are further prioritized in accordance with whether or not particular ones of said parameters actually match said entries.

14. An apparatus as described in claim 13 wherein said entries are further prioritized in accordance with the order of said entries in said table.

15. A mailing system comprising:

a) a postage meter, said postage meter being responsive to postage value data to frank a mail piece with a specified postage value and to inscription selection data to select one of a plurality of inscriptions for incorporation in a postal indicia;

b) apparatus connected to said postage meter to provide said postage value data and said inscription selection data, said apparatus comprising:

b1) input means for input of a plurality of postal information parameters for a mail piece and for input of programming; data b2) control means, responsive to said input means and having first and second modes of operation, for b2.1) in said first mode, determining said postage value data in accordance with said postal information parameters; and b2.2) determining said inscription selection data as a prioritized function of said postal information parameters, wherein said inscription selection data is incompletely determined by said postal information, so that more than one inscription selection data value can be consistent with said postal information, and said control means selects among values of said inscription selection data which are consistent with said postal information in accordance with a predetermined prioritization of said inscription selection data values; and b2.3) in said second mode, determining said function in accordance with said programming data; and c) output means, responsive to said control means, for output of said postage value data and said inscription selection data.

16. An apparatus as described in claim 15 wherein said control means comprises a memory and said prioritized function is stored in said memory as a table; each entry in said table associating an inscription code with specified values for each of said postal information parameters said values being either particular values for said parameters or a "don't care" value.

17. An apparatus as described in claim 16 wherein said inscription code for an entry is output as said inscription selection data for a mail piece if said entry is the highest priority entry consistent with the input postal information for said mail piece; and said entries are prioritized in accordance with the number of actual matches between said input postal information and said entries.

18. An apparatus as described in claim 17 wherein said entries are further prioritized in accordance with the order of said entries in said table.

* * * * *